US010519913B2

(12) United States Patent
Inoue

(10) Patent No.: US 10,519,913 B2
(45) Date of Patent: Dec. 31, 2019

(54) HIGH-PRESSURE PUMP

(71) Applicant: DENSO CORPORATION, Kariya, Aichi-pref. (JP)

(72) Inventor: Hiroshi Inoue, Anjo (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/225,305

(22) Filed: Dec. 19, 2018

(65) Prior Publication Data

US 2019/0120190 A1 Apr. 25, 2019

Related U.S. Application Data

(60) Continuation of application No. 15/900,205, filed on Feb. 20, 2018, now Pat. No. 10,184,438, which is a (Continued)

(30) Foreign Application Priority Data

Feb. 3, 2010 (JP) ..... 2010-22032

(51) Int. Cl.
*F02M 59/46* (2006.01)
*F02M 37/16* (2006.01)
(Continued)

(52) U.S. Cl.
CPC ..... *F02M 59/466* (2013.01); *F02M 37/00* (2013.01); *F02M 37/0023* (2013.01);
(Continued)

(58) Field of Classification Search
CPC .... F02M 37/00; F02M 37/0023; F02M 37/04; F02M 37/16; F02M 59/025;
(Continued)

(56) References Cited

U.S. PATENT DOCUMENTS 3,026,896 A 3/1962 Bosworth et al.
3,561,471 A 2/1971 Sands
(Continued)

FOREIGN PATENT DOCUMENTS

JP 2762652 6/1998
JP 3598610 12/2004
(Continued)

OTHER PUBLICATIONS

Crane. "Chapter 2 Flow of Fluids through Valves and Fittings." Flow of Fluids through Valves Fittings and Pipe. 2013 ed. Stamford, CT: Crane, 2013. 2-1$_+$. Print. 2-1 to 2-3, 2-6 to 2-11, 6-5, A-27 to A-29.

(Continued)

*Primary Examiner* — Patrick Hamo
*Assistant Examiner* — Joseph S. Herrmann
(74) *Attorney, Agent, or Firm* — Nixon & Vanderhye P.C.

(57) ABSTRACT

A high-pressure pump has a metering valve and a valve stopper. The stopper has a regulation portion which an end surface of the valve is brought into contact with. An outer diameter of the regulation portion is equal to an outer diameter of the outer peripheral surface of the valve. A cylindrical sleeve is disposed around the regulation portion. When the end surface of the valve is in contact with the regulation portion, the sleeve covers a tapered surface of the valve.

4 Claims, 11 Drawing Sheets

Related U.S. Application Data continuation of application No. 15/017,909, filed on Feb. 8, 2016, now Pat. No. 9,932,950, which is a continuation of application No. 14/535,943, filed on Nov. 7, 2014, now abandoned, which is a division of application No. 13/009,097, filed on Jan. 19, 2011, now Pat. No. 8,992,185.

(51) Int. Cl.

| | |
|---|---|
| ***F02M 37/00*** | (2006.01) |
| ***F02M 37/04*** | (2006.01) |
| ***F02M 59/02*** | (2006.01) |
| ***F04B 7/00*** | (2006.01) |
| ***F04B 53/10*** | (2006.01) |

(52) U.S. Cl.

CPC ..... *F02M 37/04* (2013.01); *F02M 37/16* (2013.01); *F02M 59/025* (2013.01); *F04B 7/0053* (2013.01); *F04B 7/0076* (2013.01); *F04B 53/1087* (2013.01); *Y10T 137/7837* (2015.04)

(58) Field of Classification Search

CPC ... F02M 59/466; F04B 7/0053; F04B 7/0076; F04B 53/1087; Y10T 137/7837

See application file for complete search history.

(56) References Cited

U.S. PATENT DOCUMENTS

| | | | | |
|---|---|---|---|---|
| 3,820,922 | A | 6/1974 | Buse et al. | |
| 4,815,706 | A | 3/1989 | Feuling | |
| 5,295,506 | A | 3/1994 | Smith | |
| 5,785,297 | A | 7/1998 | Ha | |
| 5,832,954 | A * | 11/1998 | Shafer | F02M 57/025 137/543.15 |
| 6,116,870 | A | 9/2000 | Kraemer | |
| 6,135,090 | A | 10/2000 | Kawachi et al. | |
| 6,253,734 | B1 * | 7/2001 | Rembold | F02D 41/3845 123/446 |
| 6,345,608 | B1 * | 2/2002 | Rembold | F02M 59/34 123/506 |
| 6,554,590 | B2 * | 4/2003 | Maeda | F02M 63/0225 123/506 |
| 6,631,706 | B1 * | 10/2003 | Yamada | F02M 59/442 123/447 |
| 7,398,764 | B2 | 7/2008 | Koehler et al. | |
| 7,717,089 | B2 * | 5/2010 | Oda | F02M 59/464 123/506 |
| 2006/0222518 | A1 * | 10/2006 | Oda | F02M 59/366 417/298 |
| 2007/0110603 | A1 | 5/2007 | Usui et al. | |
| 2009/0297375 | A1 * | 12/2009 | Inoue | F04B 7/0076 417/460 |

FOREIGN PATENT DOCUMENTS

| | | |
|---|---|---|
| JP | 2006-291838 | 10/2006 |
| JP | 3833505 | 10/2006 |
| JP | 4285883 | 6/2009 |
| JP | 2009-275540 | 11/2009 |
| JP | 2009275540 | * 11/2009 |

OTHER PUBLICATIONS

Japanese Office Action dated Jan. 27, 2012, issued in corresponding Japanese Application No. 2010-022032 with English Translation.

* cited by examiner

HIGH-PRESSURE PUMP

CROSS-REFERENCE TO RELATED APPLICATION

This application is a continuation of U.S. application Ser. No. 15/900,205 filed Feb. 20, 2018, which is a continuation of U.S. application Ser. No. 15/017,909 filed Feb. 8, 2016, which is a continuation of U.S. application Ser. No. 14/535,943 filed Nov. 7, 2014 (abandoned), which is a divisional of U.S. application Ser. No. 13/009,097 filed Jan. 19, 2011 (now U.S. Pat. No. 8,992,185), which is based on Japanese Patent Application No. 2010-22032 filed Feb. 3, 2010, the disclosure of which is incorporated herein by reference.

FIELD OF THE INVENTION

The present invention relates to a high-pressure pump used for an internal combustion engine.

BACKGROUND OF THE INVENTION

The high-pressure pump is generally provided with a plunger which reciprocates along a camshaft of an engine. Specifically, when the plunger slides down from its top dead center to its bottom dead center, a fuel in a fuel gallery is suctioned into a pressurization chamber (suction stroke). When the plunger slides up from the bottom dead center to the top dead center, a part of the low-pressure fuel is returned to the fuel gallery from the pressurization chamber (metering stroke). Then, after a metering valve is closed, when the plunger further slides up, the fuel in the pressurization chamber is pressurized by the plunger (pressurization stroke).

During the metering stroke, the metering valve is lifted up. If dynamic pressure of fuel returning from the pressurization chamber to the fuel gallery is allied to the lifted metering valve, the valve is brought into a closed position by itself. This phenomenon is referred to as self-closing phenomenon. The dynamic pressure corresponds to kinetic energy per unit volume of the fluid.

Japanese Patent No. 3833505 shows a metering valve having a cup-shaped valve body in which a spring is provided. A stopper defines a fuel passage and a sliding surface on which valve body slides. In order to avoid wringing, fuel is introduced inside of the valve body. The dynamic pressure of fuel discharged during the metering stroke is applied to an inside surface of the valve body, which may cause the self-closing phenomenon.

Japanese Patent No. 2762652 and Japanese Patent No. 4285883 show a valve having a fuel passage radially outside of a contacting surface between the valve and the stopper. Specifically, in Japanese Patent No. 2762652, a stopper is provided with a penetrating hole, whereby it is restricted that the dynamic pressure of fuel is applied to a tip surface of the valve. In Japanese Patent No. 4285883, a stopper plate has a notch portion, whereby it is restricted that the dynamic pressure of fuel is applied to a tip surface of the valve.

In Japanese Patent No. 2762652, since the tip surface of the valve defines a valve lift amount, the tip surface is polished. Thus, an outer periphery of the tip surface is tapered. Also in Japanese Patent No. 4285883, an outer periphery of the valve is tapered.

As above, in the conventional valve, although the dynamic pressure of fuel is not applied to a tip surface of the valve, the dynamic pressure of fuel is applied to the tapered surface, which may cause a self-closing phenomenon.

SUMMARY OF THE INVENTION

The present invention is made in view of the above matters, and it is an object of the present invention to provide a high-pressure pump in which it is restricted that dynamic pressure of fuel is applied to a valve and a self-closing phenomenon occurs during a metering stroke.

According to the present invention, a high-pressure pump performs a metering stroke in which a part of fuel suctioned into a pressurization chamber from a fuel gallery is returned to the fuel gallery. The high-pressure pump is provided with a housing, a seat body, a valve, a valve stopper, and a cylindrical sleeve.

The housing forms a contour of the high-pressure pump. The housing has a cylindrical seat body which defines a valve seat. The valve is slidably supported by the seat body.

The valve is capable of sitting on the valve seat by a fuel pressure in the pressurization chamber so as to interrupt a hydraulic communication between the pressurization chamber and the fuel gallery. An end surface of the valve is brought in contact with a regulation portion of the stopper, whereby a lift amount of the valve is restricted.

The cylindrical sleeve is disposed around the regulation portion and covers a tapered surface which is formed at outer periphery of the end surface of the valve in a situation that the end surface of the valve is in contact with the regulation portion. The cylindrical sleeve covers a part of tapered surface or the whole of the tapered surface.

Thereby, it is restricted that the dynamic pressure of fuel is applied to the tapered surface during a metering stroke. It is surely avoided that a self-closing phenomenon occurs during a metering stroke.

An area of the tapered surface can be enlarged. Thereby, weight of the valve can be reduced, a response is improved and noise vibration (NV) is reduced. Further, since an outer diameter of a contact surface between the valve and the regulation portion can be made smaller, a wringing force can be restricted to improve the response of the valve.

BRIEF DESCRIPTION OF THE DRAWINGS

Other objects, features and advantages of the present invention will become more apparent from the following description made with reference to the accompanying drawings, in which like parts are designated by like reference numbers and in which.

DETAILED DESCRIPTION OF EMBODIMENTS

Hereafter, embodiments of the present invention will be described hereinafter. A high-pressure pump is mounted to a vehicle for pumping up fuel in a fuel tank through a fuel inlet and pressurizes the fuel. The high-pressure pump supplies the pressurized fuel to a fuel rail to which an injector is connected. The fuel inlet of the high-pressure pump is fluidly connected to a low-pressure pump (not shown) through a pipe.

Figure 1:
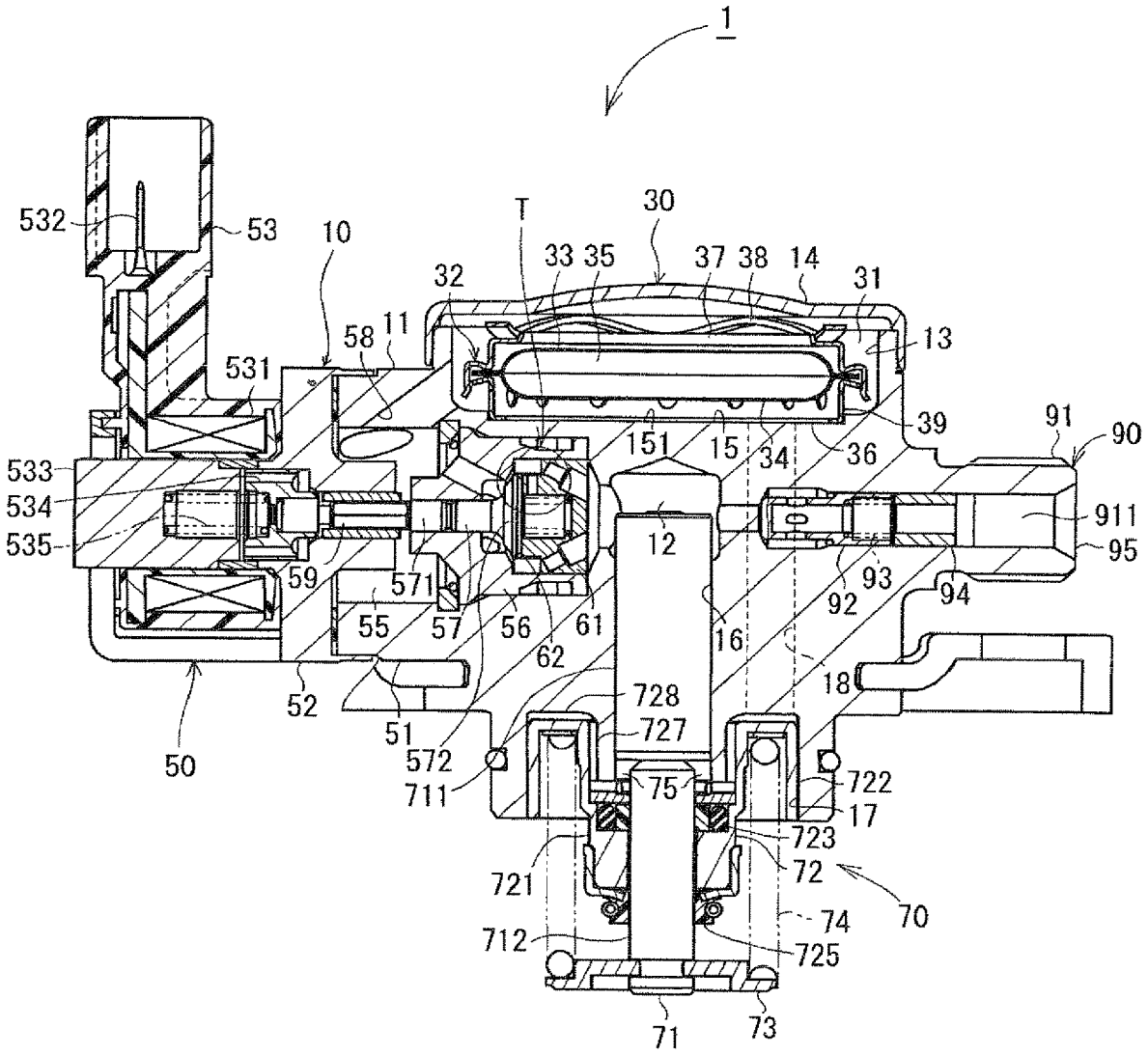
FIG. 1 is a cross-sectional view showing a high-pressure pump according to a first embodiment of the invention.

As shown in FIG. 1, a high-pressure pump 1 is comprised of a main body 10, a fuel supply portion 30, a metering valve portion 50, a plunger portion 70, and a discharge valve portion 90.

The main body 10 includes a housing 11 which forms an outer profile of the high-pressure pump 1. The fuel supply portion 30 is formed on the housing 11.

The plunger portion 70 is formed at an opposite side of the fuel supply portion 30. A pressurization chamber 12 is defined in the housing 11 between the plunger portion 70 and the fuel supply portion 30. The metering valve portion 50 and the discharge valve portion 90 are formed at left side and right side of the main body 10 respectively.

Then, the configurations of the fuel supply portion 30, the metering valve portion 50, the plunger portion 70, and the discharge valve portion 90 will be described in detail, hereinafter.

The fuel supply portion 30 includes a fuel gallery 31. The fuel gallery 31 is a space defined by a concave portion 13 of the housing 11 and a lid member 14. A damper unit 32 is provided in the fuel gallery 31. The damper unit 32 is comprised of a damper member 35, a bottom-side supporting member 36 disposed on a bottom 15 of the concave portion 13, and a lid-side supporting member 37 disposed under the lid member 14. The damper member 35 is comprised of two metallic diaphragms 33, 34. The fuel gallery 31 has a recess portion 151 receiving the bottom-side supporting member 36. The position of the bottom-side supporting member 36 is fixed by the recess portion 151.

A wavy disc spring 38 is disposed on the lid-side supporting member 37. In a condition where the lid member 14 is attached to the housing 11, the wavy disc spring 38 urges the lid-side supporting member 37 toward the bottom 15. Consequently, an outer periphery of the damper member 35 is cramped by the lid-side supporting member 37 and the bottom-side supporting member 36, whereby the damper member 35 is supported in the fuel gallery 31.

Then, the plunger portion 70 will be described. As shown in FIG. 1, the plunger portion 70 includes a plunger 71, an oil-seal holder 72, a spring seat 73 and a plunger-spring 74.

The plunger 71 has a large diameter portion 711 and a small diameter portion 712. The large diameter portion 711 is slidablly supported in a cylinder 16 which is formed in the housing 11. The small diameter portion 712 is surrounded by an oil seal holder 72. An outer diameter of the small diameter portion 712 is smaller than that of the large diameter portion 711. The small diameter portion 712 is surrounded by the oil-seal holder 25. The large diameter portion 711 and the small diameter portion 712 axially reciprocate.

The oil-seal holder 72 is arranged at an opening end of the cylinder 16 and has a base portion 721 surrounding the small diameter portion 712 of the plunger 71 and a press-insert portion 722 which is press-inserted into the housing 11.

The base portion 721 has a ring-shaped seal 723 therein. The ring-shaped seal 723 is comprised of an inner seal member and an outer O-ring. A thickness of the fuel on the small diameter portion 712 is adjusted by the ring-shaped seal 723 to restrict a leakage of the fuel.

The base portion 721 has an oil-seal 725 on its tip end. A thickness of the oil on the small diameter portion 712 is adjusted by the oil-seal 725 to restrict a leakage of the oil.

The press-insert portion 722 cylindrically extends from the base portion 721. Meanwhile, the housing 11 has a concave portion 17 receiving the press-insert portion 722. Thereby, the oil-seal holder 72 is press-inserted into the housing 11 in such a manner that the press-insert portion 722 is press-fitted to an outer wall of the concave portion 17.

A spring seat 73 is provided at an end of the plunger 71. The tip end of the plunger 71 is in contact with a tappet (not shown). The tappet is in contact with a cam (not shown) of a camshaft and reciprocates according to a cam profile of the cam. Thereby, the plunger 71 reciprocates in its axial direction.

One end of the plunger spring 74 is engaged with the spring seat 73 and the other end of the plunger spring 74 is engaged with the press-insert portion 722. The plunger spring 74 biases the plunger 71 downwardly so that the plunger 71 is in contact with the tappet.

The plunger 71 reciprocates along with a cam profile of a camshaft. According to a reciprocation of the large diameter portion 711 of the plunger 71, a volume of the pressurization chamber 12 is varied.

Moreover, a variable volume chamber 75 is defined around the small diameter portion 712 of the plunger 71. In the present embodiment, the variable volume chamber 75 is defined by the cylinder 16, a bottom end of the large diameter portion 711 of the plunger 71, an outer surface of the small diameter portion 712, and the seal 723 of the oil-seal holder 72. The seal 723 hermetically seals the variable volume chamber 75 to avoid a fuel leakage therefrom.

The variable volume chamber 75 is fluidly connected to the fuel gallery 31 through a cylindrical passage 727 formed between the press-insert portion 722 and the concave portion 17, an annular passage 728 formed at a bottom of the concave portion 17, and a return passage 18 formed in the housing 11 which is illustrated by dashed lines in FIG. 1.

Next, the metering valve portion 50 will be described in detail. As shown in FIG. 1, the metering valve portion 50 includes a cylindrical portion 51 of the housing 11, a valve cover 52 which covers an opening of the cylindrical portion 51, and a connector 53. The cylindrical portion 51 defines a fuel passage 55 therein. A cylindrical seat body 56 is provided in the fuel passage 55. The seat body 56 slidablly supports a valve 57 therein. The valve 57 can be lifted up toward the pressurization chamber 12. The lift amount of the valve 57 is restricted by the stopper 61. Further, the fuel passage 55 communicates with the fuel gallery 31 through a press-side passage 58.

A needle 59 is in contact with the valve 57. This needle 59 penetrates the valve cover 52 and extends to an interior of the connector 53. The connector 53 has a coil 531 and a terminal 532 for energizing the coil 531. A fixed core 533, a movable core 534, and a spring 535 are disposed inside of the coil 531. The needle 59 is mechanically connected to the movable core 534. That is, the movable core 534 and the needle 59 slide together.

When the coil 531 is energized through the terminal 532, a magnetic attraction force is generated between the fixed core 533 and the movable core 534. The movable core 534 is attracted to the fixed core 533 with the needle 59. At this time, a movement of the valve 57 is not restricted by the needle 59. Thus, the valve 57 seats on the seat body 56 to disconnect the fuel passage 55 and the pressurization chamber 12.

A biasing force of the spring 535 is greater than that of the spring 614. Thus, when the coil 531 is deenergized, the movable core 534 moves apart from the fixed core 533 by a biasing force of the spring 535. The needle 59 comes close to the compression chamber 12. The movement of the valve 57 is restricted by the needle 59. The valve 57 is unseated from the seat body 56 so that the fuel passage 55 communicates with the pressurization chamber 12.

Then, the discharge valve portion 90 will be described in detail, hereinafter. The discharge valve portion 90 has a cylindrical accommodation portion 91 of the housing 11, as shown in FIG. 1. The accommodation portion 91 defines an accommodation chamber 911 in which a discharge valve 92, a spring 93 and an engaging member 94 are provided. An opening portion of the accommodation chamber 911 corresponds to a discharge port 95. A valve seat is formed in the accommodation chamber 911.

The discharge valve 92 is biased to the valve seat by the spring 93 and a fuel pressure from a fuel rail (not shown). While the fuel pressure in the pressurization chamber 12 is relatively low, the discharge valve 92 seats on the valve seat so that no fuel is discharged from the discharge port 95. Meanwhile, when the fuel pressure in the pressurization chamber 12 exceeds the biasing force of the spring 93 and the fuel pressure from the fuel rail, the discharge valve 92 is unseated from the valve seat, so that the fuel in the compression chamber 12 is discharged from the discharge port 95. Thereby, the fuel in the accommodation chamber 911 is discharged from the discharge port 95.

Figure 2A:
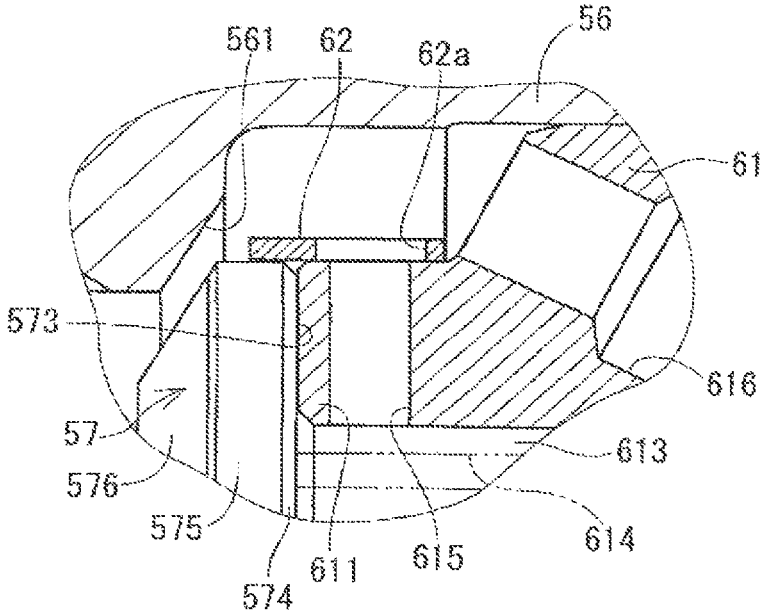
FIG. 2A is a fragmentary sectional view showing an essential portion of the metering valve according to the first embodiment.

In the present embodiment, the metering valve 50, which is encircled by "T" in FIG. 1, has features. FIG. 2A is a fragmentary cross sectional view showing an essential portion of the metering valve 50. The seat body 56 slidably supports the valve 57. The seat body 56 is cylindrical and has a valve seat 561.

The valve 57 is provided with a shaft portion 571 and a radially enlarged portion 572 (refer to FIG. 1). As shown in FIG. 2A, the radially enlarged portion 572 is comprised of an end surface 573, a tapered surface 574, an outer peripheral surface 575 and a seat surface 576 which can sit on the valve seat of the seat body 56.

The stopper 61 has a fuel passage 616 communicating with the pressurization chamber 12. Further, the stopper 61 has a regulation portion 611 which the end surface 573 is brought into contact with. The area of regulation portion 611 which is in contact with the end surface 537 of valve 57 when the valve 57 abuts the stopper 61 define a contact surface. An outer diameter of the regulation portion 611 is equal to an outer diameter of the outer peripheral surface 575 of the valve 57. Further, the regulation portion 611 has an inner wall 610 that defines an accommodation space 613 therein. This accommodation space 613 accommodates a spring 614 which biases the valve 57 toward the valve seat 561. The regulation portion 611 has a tunnel passage 615 which communicates the accommodation space 613 with exterior thereof.

A cylindrical sleeve 62 is disposed around the regulation portion 611. The sleeve 62 has an aperture 62*a* communicating with the tunnel passage 615. The sleeve 62 protrudes to the valve 57 from the regulation portion 611. At least when the end surface 573 is in contact with the regulation portion 611, the sleeve 62 covers the tapered surface 574 of the valve 57.

During a metering stroke, the end surface 573 is in contact with the regulation portion 611 and the fuel in the pressurization chamber 12 is returned to the fuel gallery 31 through the fuel passage 616.

The valve 57 is positioned away from the valve seat 561 by a biasing force of the spring 535.

If the sleeve 62 is not provided, it is necessary to increase a biasing force of the spring 535 in order to restrict the self-closing phenomenon. Consequently, it is necessary to increase magnetic attraction force when the valve 57 is opened. The metering valve portion 50 becomes larger and its control current increases.

Contrarily, according to the present embodiment, the sleeve 62 covers the tapered surface 574 of the valve 57. Thereby, it is restricted that the dynamic pressure of fuel is applied to the tapered surface 574. It is surely avoided that a self-closing phenomenon occurs during a metering stroke. Consequently, the metering valve portion 50 can be made smaller and its control current can be reduced, which can improve fuel economy.

Furthermore, according to the present embodiment, the regulation portion 611 includes the tunnel passage 615 and the sleeve 62 includes the aperture 62*a*. The accommodation space 613 communicates with the exterior space through the aperture 62*a* and the tunnel passage 615. Thereby, a wringing force is restricted and a response of the valve 57 is ensured when closing.

Figure 2B:
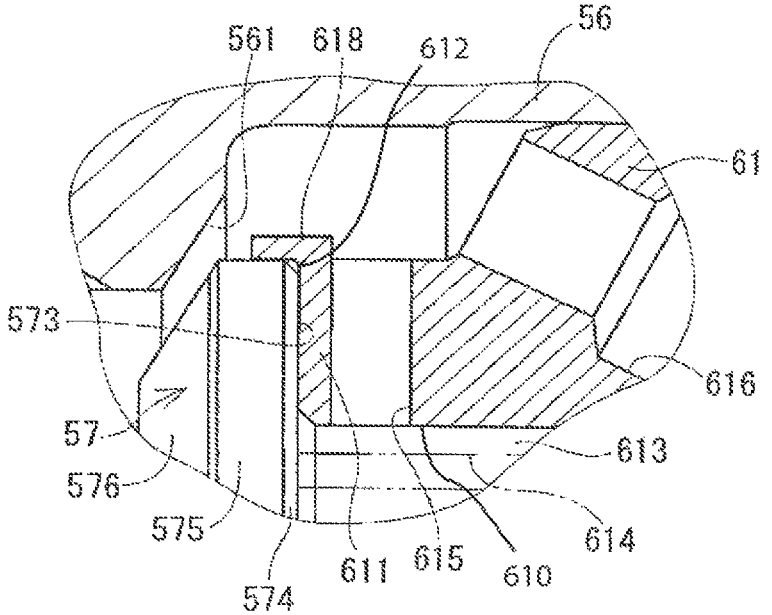
FIG. 2B is a fragmentary cross-sectional view showing an essential portion of the metering valve according to a modification of the first embodiment.

As shown in FIG. 2B, the sleeve 618 and the regulation portion 611 can be made from a single integrated piece structure. A protruding amount of the sleeve 618 from the regulation portion 611 can be precisely defined such that the valve 57 and the stopper 61 define a clearance 612 therebetween, whereby dispersion in response of the valve 57 can be restricted. Furthermore, the clearance 612 increases in length in the valve-opening-and-closing direction toward the outside.

Figure 3:
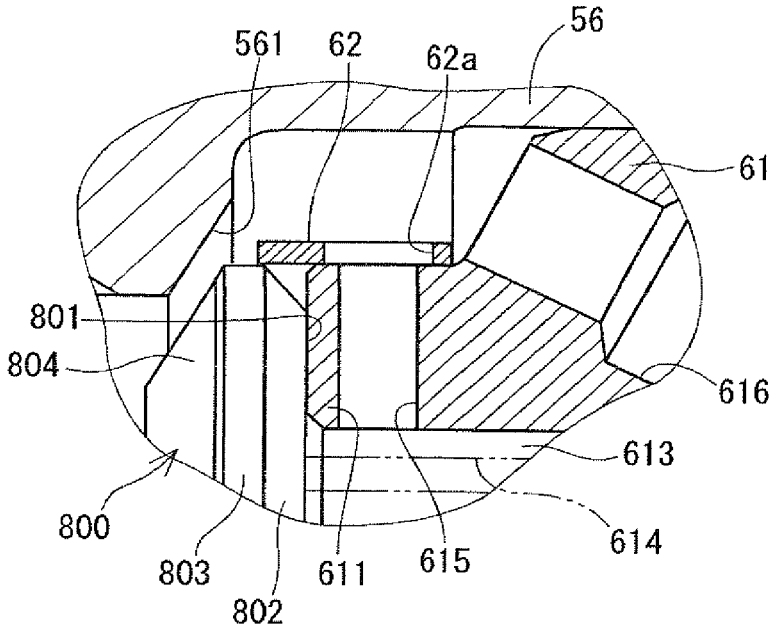
FIG. 3 is a fragmentary cross-sectional view showing an essential portion of the metering valve according to another modification of the first embodiment.

Also, as shown in FIG. 3, a tapered surface 802 may be enlarged. A valve 800 shown in FIG. 3 has an end surface 801, a tapered surface 802, an outer peripheral surface 803 and a seat surface 804. An area of the tapered surface 802 is larger than that of the tapered surface 574 shown in FIG. 2A. Thereby, weight of the valve 800 can be reduced, a response is improved and noise vibration (NV) is reduced. Further, since an outer diameter of a contact surface between the valve 800 and the regulation portion 611 can be made smaller, a wringing force can be restricted to improve the response of the valve 800.

Second Embodiment

In a second and the successive embodiments, the same parts and components as those in the first embodiment are indicated with the same reference numerals and the same descriptions will not be reiterated.

In the second embodiment, a configuration of the sleeve is different from that in the first embodiment.

Figure 4A:
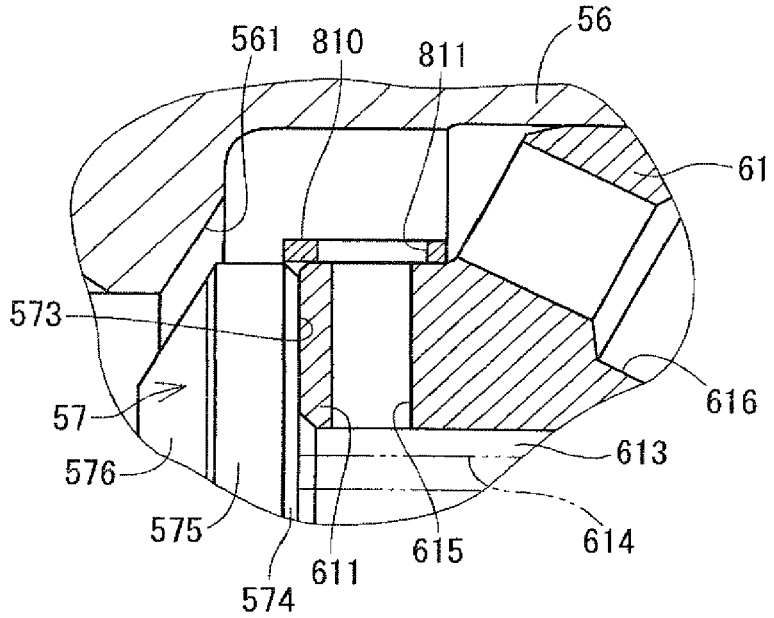
FIGS. 4A and 4B are fragmentary sectional views showing an essential portion of the metering valve according to a second embodiment.
Figure 4B:
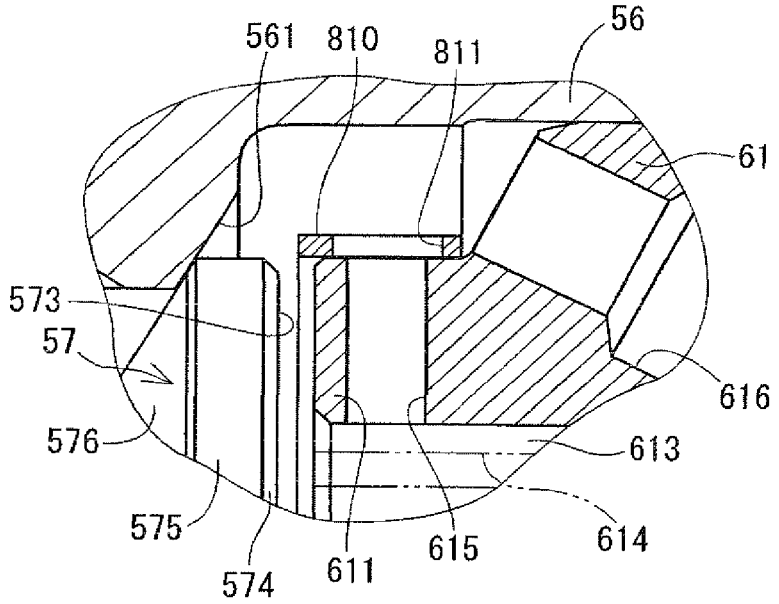

A sleeve 810 shown in FIGS. 4A and 4B has an aperture 811 communicating with the tunnel passage 615. When the end surface 573 is in contact with the regulation portion 611 as shown in FIG. 4A, the sleeve 810 protrudes in such a manner as to cover only the tapered surface 574. In other words, an open end of the sleeve 810 is positioned at a boundary between the tapered surface 574 and the outer peripheral surface 575. The dynamic pressure of fuel is applied to the tapered surface 574 as soon as the valve 57 moves from a position shown in FIG. 4A toward a position shown in FIG. 4B. Thus, a closing response of the valve 57 is improved.

Third Embodiment

In a third embodiment, a configuration of the sleeve is different from those in the above embodiments.

Figure 5:
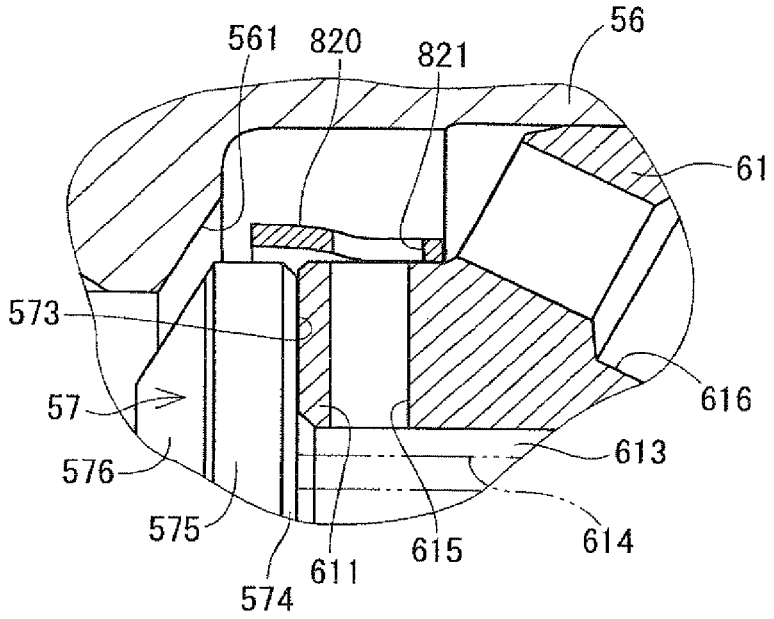
FIG. 5 is a fragmentary sectional view showing an essential part of a high-pressure pump according to a third embodiment.

A sleeve 820 shown in FIG. 5 has an open end of which inner diameter is larger than the outer diameter of the outer peripheral surface 575. The sleeve 820 restricts the dynamic pressure of fuel applied to the tapered surface 574 and ensures a fuel flow to the tapered surface 574. Thus, the advantages of the above embodiments can be achieved, and a deterioration in response due to damper effect can be avoided. It is unnecessary that the outer diameter of the regulation portion 611 coincides with the outer diameter of the outer peripheral surface 575.

Fourth Embodiment

In a fourth embodiment, a configuration of the sleeve is different from that in the above embodiments.

Figure 6:
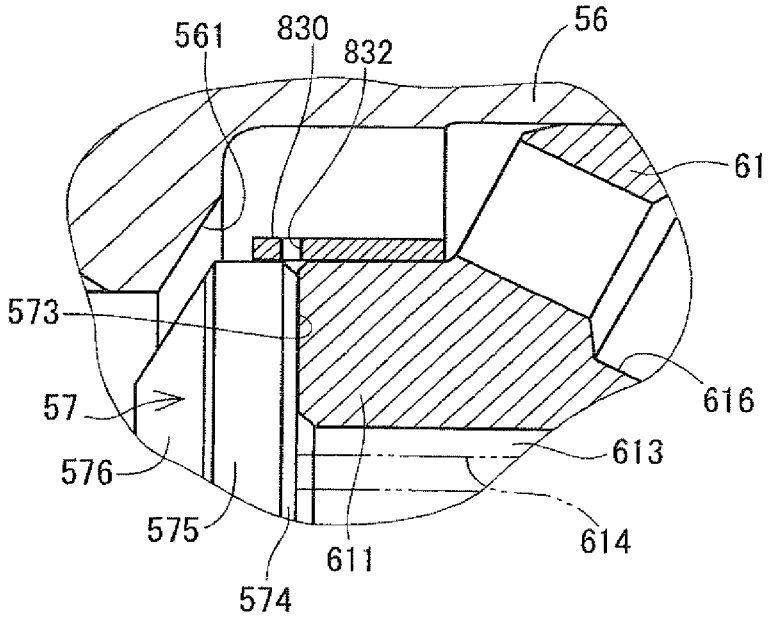
FIG. 6 is a fragmentary sectional view showing an essential portion of the metering valve according to a fourth embodiment.

A sleeve 830 shown in FIG. 6 has a penetrating hole 832 confronting to the tapered surface 574. A diameter of the penetrating hole 832 is defined in such a manner that the dynamic pressure of fuel is not applied to the tapered surface 574. The sleeve 830 restricts the dynamic pressure of fuel applied to the tapered surface 574 and ensures a fuel flow to the tapered surface 574. Thus, the advantages of the above embodiments can be achieved, and a deterioration in response due to damper effect can be avoided.

Fifth Embodiment

Figure 7A:
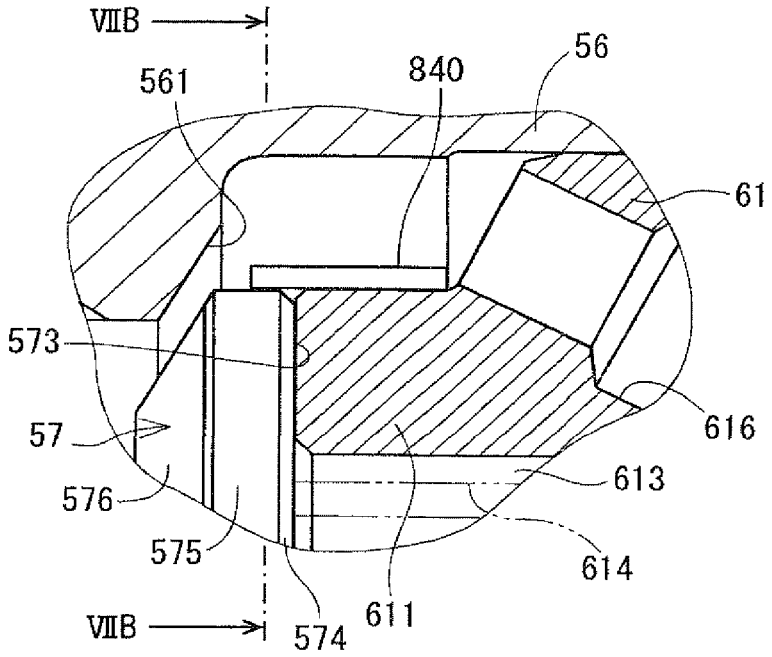
FIG. 7A is a fragmentary cross sectional view showing an essential portion of the metering valve according to a fifth embodiment.
Figure 7B:
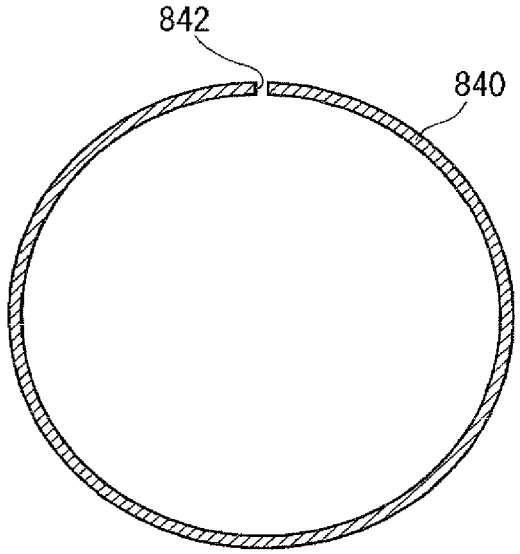
FIG. 7B is a cross sectional view of a sleeve taken along a line VIIB-VIIB in FIG. 7A.

In the second embodiment, a configuration of the sleeve is different from that in the first embodiment. FIG. 7A is a fragmentary cross sectional view showing an essential portion of the metering valve 50. FIG. 7B is a cross sectional view taken along a line VIIB-VIIB in FIG. 7A.

A sleeve 840 shown in FIGS. 7A and 7B is formed by cylindrically bending a plate member. A slit 842 is formed between both ends of the plate member. This slit 842 performs the same functions as the penetrating hole 832 in the fourth embodiment. Thus, a deterioration response due to a damper effect can be avoided. The slit 842 can be easily formed.

Sixth Embodiment

Figure 8A:
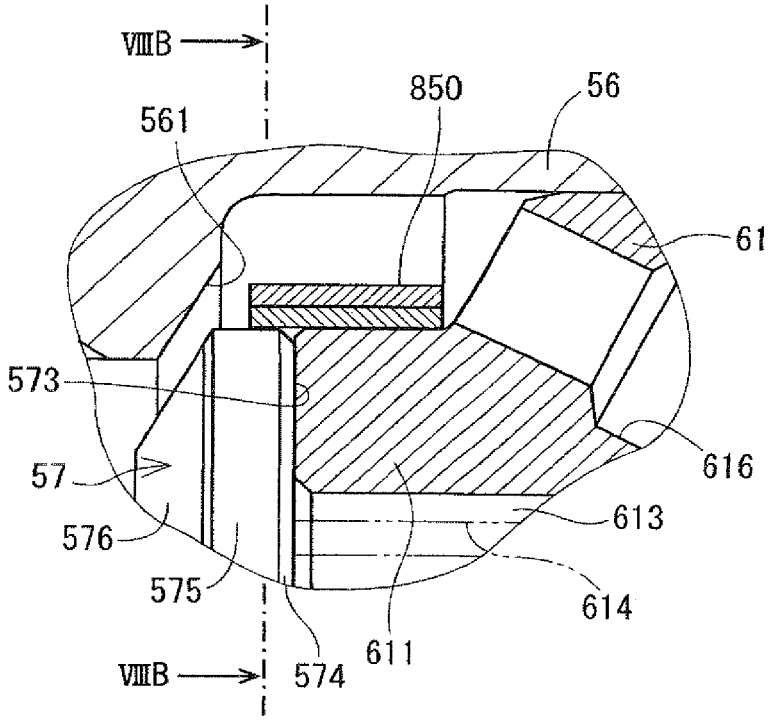
FIG. 8A is a fragmentary cross sectional view showing an essential portion of the metering valve according to a sixth embodiment.
Figure 8B:
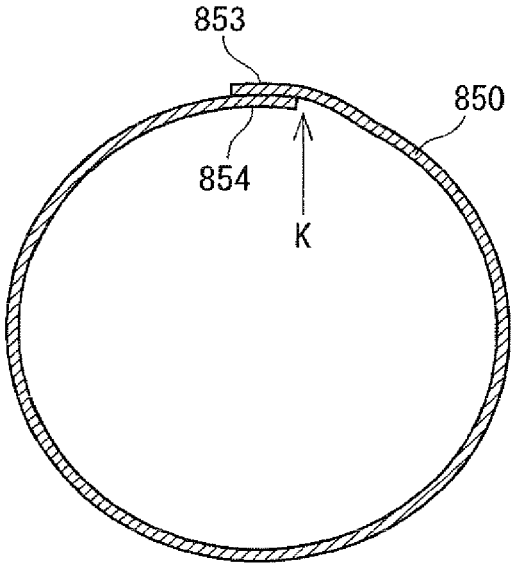
FIG. 8B is a cross sectional view of a sleeve taken along a line VIM-VIM in FIG. 8A.

In the second embodiment, a configuration of the sleeve is different from that in the first embodiment. FIG. 8A is a fragmentary cross sectional view showing an essential portion of the metering valve 50. FIG. 8B is a cross sectional view taken along a line VIM-VIM in FIG. 8A.

A sleeve 850 shown in FIGS. 8A and 8B is formed by cylindrically bending a plate member. Both ends of the plate member are overlapped to define an axial space denoted by "K" in FIG. 8B. Thus, a deterioration response due to a damper effect can be avoided.

Seventh Embodiment

Figure 9A:
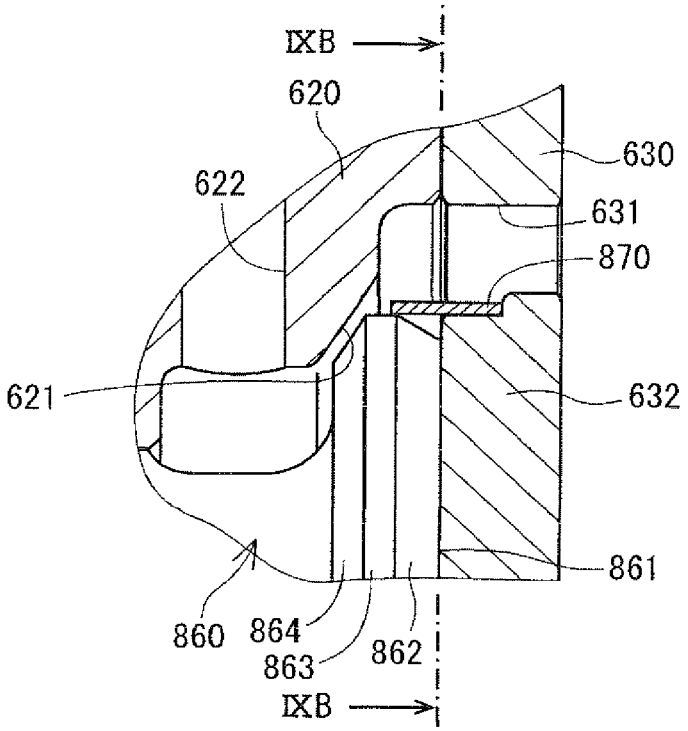
FIG. 9A is a fragmentary cross sectional view showing an essential portion of the metering valve according to a seventh embodiment.
Figure 9B:
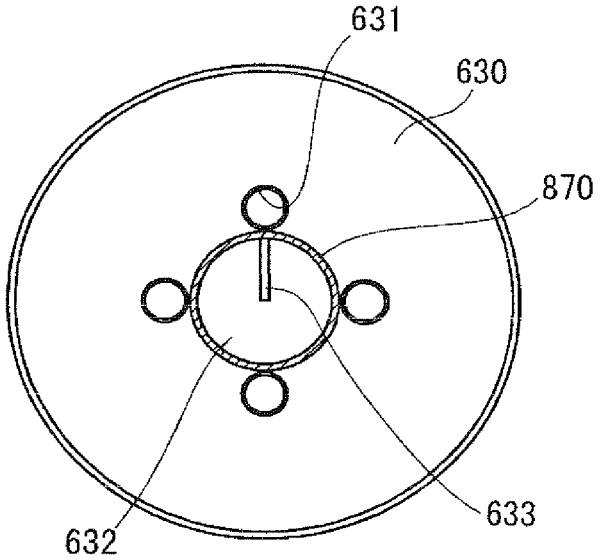
FIG. 9B is a cross sectional view taken along a line IXB-IXB in FIG. 9A.

FIG. 9A is a fragmentary cross sectional view showing an essential portion of the metering valve 50. FIG. 9B is a cross sectional view taken along a line IXB-IXB in FIG. 9A.

A seat body 620 has a valve seat 621 and a fuel passage 622 communicating with the fuel gallery. Further, a stopper 630 has a fuel passage 631 communicating with the pressurization chamber. As shown in FIG. 9B, the fuel passage 631 is comprised of four passages which are circumferentially arranged. An inside portion of the fuel passages 631 corresponds to a regulation portion 632. The regulation portion 632 has a groove 633 which extends outwardly from its center. Thereby, a wringing force is restricted and a response of the valve 860 is improved when closing.

The valve 860 includes an end surface 861, a tapered surface 862, an outer peripheral surface 863 and a seat surface 864 which can sit on the valve seat 620 of the seat body 620.

A cylindrical sleeve 870 is disposed around the regulation portion 632. A sleeve 870 has an open end of which inner diameter is substantially equal to the outer diameter of the outer peripheral surface 863. When the end surface 861 is in contact with the regulation portion 632, the sleeve 870 covers a tapered surface 862 of the valve 860.

In the present embodiment, the valve 860 is integrally formed with a needle. Unlike the above embodiments, the stopper 630 has no accommodation space and no spring biasing the valve 860 toward the valve seat 621.

Figure 10:
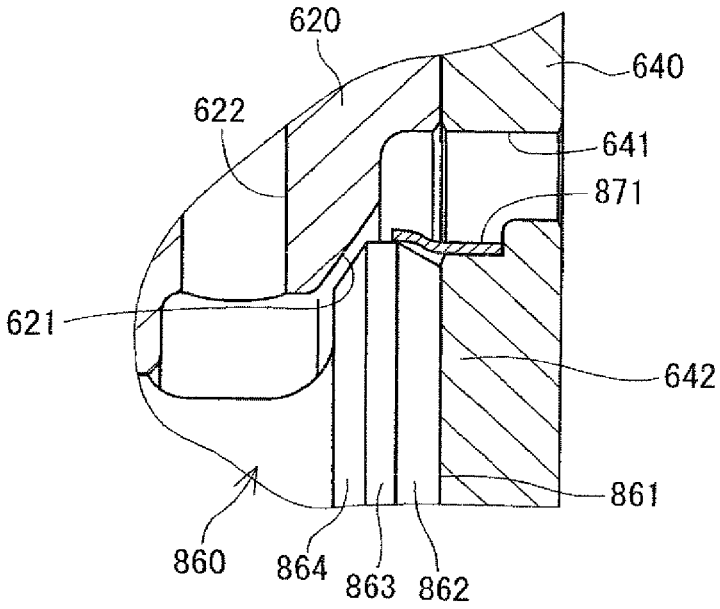
FIG. 10 is a fragmentary cross-sectional view showing an essential portion of the metering valve according to a modification of a seventh embodiment.

As shown in FIG. 10, a sleeve 871 having an enlarged open end can be employed.

Figure 13:
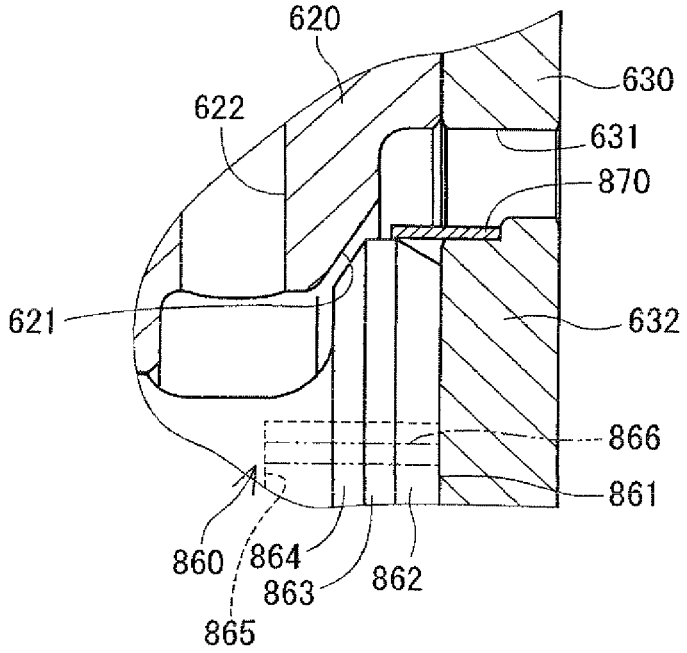
FIG. 13 is a cross-sectional view showing an essential portion of the metering valve according to a modification of the seventh and eighth embodiments.

In a case that the valve 860 and the needle are not formed from a single integrated piece, the valve 860 defines an accommodation space 865 in which a spring 866 is disposed. One end of the spring 866 is engaged with the regulation portion 632, as shown in FIG. 13.

Eighth Embodiment

Figure 11A:
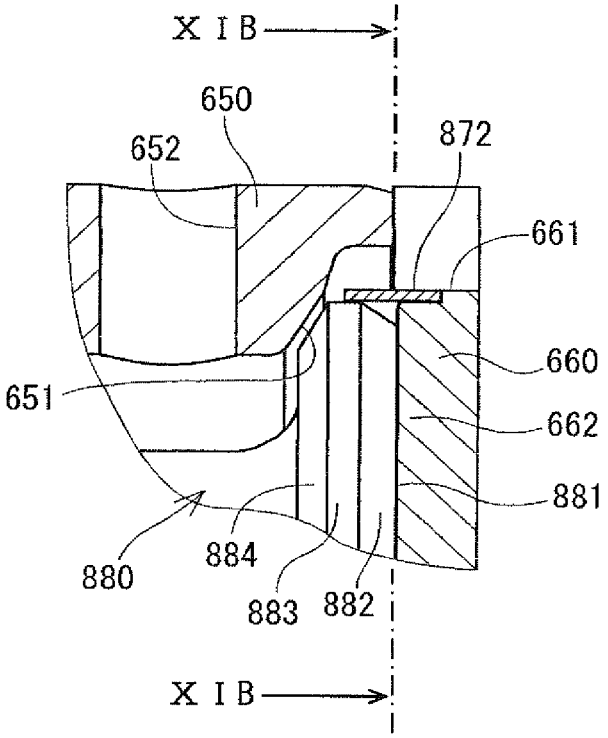
FIG. 11A is a fragmentary cross sectional view showing an essential portion of the metering valve according to an eighth embodiment.
Figure 11B:
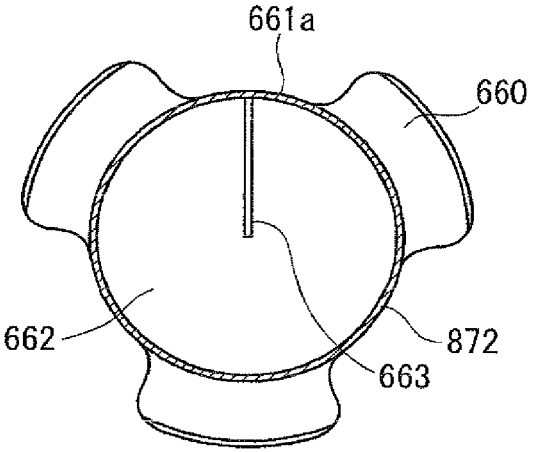
FIG. 11B is a cross sectional view taken along a line XIB-XIB in FIG. 11A.

FIG. 11A is a fragmentary cross sectional view showing an essential portion of the metering valve 50. FIG. 11B is a cross sectional view taken along a line XIB-XIB in FIG. 11A.

A seat body 650 includes a valve seat 651 and a fuel passage 652 which communicates with the fuel gallery. Further, a stopper 660 includes a fuel passage 661 which communicates with the pressurization chamber. As shown in FIG. 11B, the fuel passage 661 is comprised of three notches 661*a*. An inside portion of the fuel passages 661 corresponds to a regulation portion 662. The regulation portion 662 has a groove 663 which extends outwardly from its center. Thereby, a wringing force is restricted and a response of the valve 880 is improved when closing.

The valve 880 includes an end surface 881, a tapered surface 882, an outer peripheral surface 883 and a seat surface 884 which can sit on the valve seat 651 of the seat body 650.

A cylindrical sleeve 872 is disposed around the regulation portion 662. When the end surface 881 is in contact with the regulation portion 662, the sleeve 872 covers a tapered surface 882 of the valve 880.

The valve 880 is integrally formed with a needle. Unlike the above embodiments, the stopper 660 has no accommodation space and no spring biasing the valve 880 toward the valve seat 651.

Figure 12:
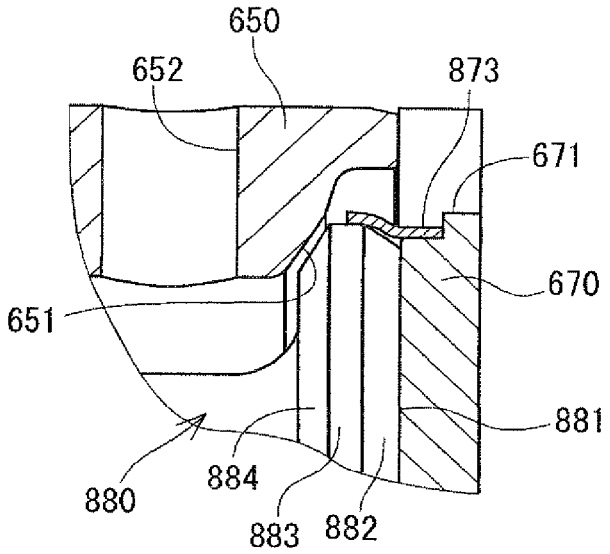
FIG. 12 is a fragmentary cross-sectional view showing an essential portion of the metering valve according to a modification of the eighth embodiment.

As shown in FIG. 12, a sleeve 873 having an enlarged open end can be employed.

The configuration shown in FIG. 13 can be applied to the valve 880 shown in FIGS. 11A to 12.

The present invention is not limited to the embodiments mentioned above, and can be applied to various embodiments.

What is claimed is:

1. A high-pressure pump comprising:

a plunger performing a reciprocating movement;

a housing defining a pressurization chamber and a first fuel passage for introducing a fuel toward the pressurization chamber;

a cylindrical seat body which has a valve seat;

a valve which has a seat surface that is integrated in one piece with a disk portion and a flat end surface;

a stopper which has a surface confronting the valve;

an electromagnetic drive portion which generates an electromotive force so as to move the valve in a valve-opening-and-closing direction, a spring which is disposed between the valve and the stopper so as to bias the valve toward the vale seat, wherein the valve is located between the electromagnetic drive portion and the pressurization chamber, a second fuel passage is arranged between the valve seat and the pressurization chamber in such a manner as to fluidly connect the seat surface of the valve with the pressurization chamber, the valve and the stopper are configured in such a manner that the valve is able to abut on the stopper at a position radially outside of the spring, the stopper has a cylindrical portion, the stopper is configured to form an accommodation space defined by an inner wall of the cylindrical portion and the valve and configured to be filled with the fuel, the second fuel passage is defined radially outside of the cylindrical portion, the accommodation space is connected with the second fuel passage through a passage, which extends in a direction perpendicular to the valve-opening-and-closing direction, the passage is connected with the second fuel passage at a position radially outside of the valve, the valve and the stopper define a contact surface therebetween when being in contact with each other and define a clearance therebetween radially outside of the contact surface, and the clearance increases in length in the valve-opening-and-closing direction toward the radially outside.

2. The high-pressure pump according to claim 1, wherein the valve has a tapered surface radially outside of the contact surface.

3. The high-pressure pump according to claim 1, wherein the stopper defines the passage therein.

4. The high-pressure pump according to claim 1, wherein the accommodation space accommodates the spring.

* * * * *